US006470701B2

(12) United States Patent
Tchougounov et al.

(10) Patent No.: US 6,470,701 B2
(45) Date of Patent: Oct. 29, 2002

(54) ICE MAKER AND METHOD OF MAKING ICE

(75) Inventors: Andrei Tchougounov, Ligonier; Robert G. Cox, Goshen; Donald E. De Witt, Syracuse, all of IN (US)

(73) Assignee: Dekko Heating Technologies, Inc., North Webster, IN (US)

( * ) Notice: Subject to any disclaimer, the term of this patent is extended or adjusted under 35 U.S.C. 154(b) by 0 days.

(21) Appl. No.: 09/780,047

(22) Filed: Feb. 9, 2001

(65) Prior Publication Data

US 2001/0011461 A1 Aug. 9, 2001

Related U.S. Application Data

(63) Continuation-in-part of application No. 09/499,011, filed on Feb. 4, 2000, which is a continuation-in-part of application No. 09/285,283, filed on Apr. 2, 1999, now Pat. No. 6,082,121.

(51) Int. Cl.[7] ..... F25C 1/12
(52) U.S. Cl. ..... 62/347; 62/353
(58) Field of Search ..... 62/74, 347, 353

(56) References Cited

U.S. PATENT DOCUMENTS

| | | | | | |
|---|---|---|---|---|---|
| 948,131 | A | | 2/1910 | Bull | 62/356 |
| 1,963,842 | A | | 6/1934 | Gay | 62/105 |
| 2,775,101 | A | | 12/1956 | Hanson | 62/356 |
| 3,005,322 | A | * | 10/1961 | Harle | 62/353 |
| 3,180,105 | A | * | 4/1965 | Frohbieter | 62/353 |
| 3,196,624 | A | | 7/1965 | Reynolds | 62/71 |
| 3,274,792 | A | | 9/1966 | Weil et al. | 62/354 |
| 3,283,526 | A | * | 11/1966 | LeBoeuf | 62/353 |
| 3,654,772 | A | | 4/1972 | Curry, III | 62/353 |
| 3,678,701 | A | | 7/1972 | Powell et al. | 62/353 |
| 3,708,992 | A | | 1/1973 | Clearman et al. | 62/71 |
| 3,896,631 | A | | 7/1975 | Morrison | 62/71 |
| 3,984,996 | A | | 10/1976 | Bright | 62/353 |
| 4,003,214 | A | | 1/1977 | Schumacher | 62/340 |
| 4,059,970 | A | * | 11/1977 | Loeb | 62/353 |
| 4,183,222 | A | | 1/1980 | Swanson | 62/71 |
| 4,261,182 | A | * | 4/1981 | Elliott | 62/353 |
| 4,355,522 | A | | 10/1982 | Gorski et al. | 62/340 |
| 4,429,543 | A | | 2/1984 | Fischer | 62/347 |
| 4,732,006 | A | * | 3/1988 | Fischer | 62/353 |
| 4,901,539 | A | | 2/1990 | Garber et al. | 62/356 |
| 4,923,494 | A | * | 5/1990 | Karlovits | 62/353 |
| 5,167,132 | A | | 12/1992 | Meier | 62/356 |

* cited by examiner

*Primary Examiner*—William E. Tapolcai
(74) *Attorney, Agent, or Firm*—Taylor & Aust, P.C.

(57) ABSTRACT

An ice maker includes a mold with at least one cavity for containing water therein for freezing into ice. Each cavity has a plurality of side walls. An ice removal device is positioned at least partly within the at least one mold cavity. A fill tube is positioned in association with the at least one mold cavity. The fill tube includes an outlet from which water is expelled at an impingement angle against at least one side wall of at least one mold cavity. The impingement angle is between about 10° and 60° relative to a horizontal reference.

23 Claims, 4 Drawing Sheets

ICE MAKER AND METHOD OF MAKING ICE

CROSS REFERENCE TO RELATED APPLICATIONS

This is a continuation-in-part of U.S. patent application Ser. No. 09/499,011, entitled "ICE MAKER", filed Feb. 4, 2000, which is a continuation in part of U.S patent application Ser. No. 09/285,283, entitled "ICE MAKER", filed Apr. 2, 1999, now U.S. Pat. No. 6,082,121.

BACKGROUND OF THE INVENTION

1. Field of the Invention

The present invention relates to freezers, and, more particularly, to ice makers within freezers.

2. Description of the Related Art

The freezer portion of a refrigeration/freezer appliance often includes an ice cube maker which dispenses the ice cubes into a dispenser tray. A mold has a series of cavities, each of which is filled with water. The air surrounding the mold is cooled to a temperature below freezing so that each cavity forms an individual ice cube. As the water freezes, the ice cubes become bonded to the inner surfaces of the mold cavities.

In order to remove an ice cube from its mold cavity, it is first necessary to break the bond that forms during the freezing process between the ice cube and the inner surface of the mold cavity. In order to break the bond, it is known to heat the mold cavity, thereby melting the ice contacting the mold cavity on the outermost portion of the cube. The ice cube can then be scooped out or otherwise mechanically removed from the mold cavity and placed in the dispenser tray. A problem is that, since the mold cavity is heated and must be cooled down again, the time required to freeze the water is lengthened.

Another problem is that the heating of the mold increases the operational costs of the ice maker by consuming electrical power. Further, this heating must be offset with additional refrigeration in order to maintain a freezing ambient temperature, thereby consuming additional power. This is especially troublesome in view of government mandates which require freezers to increase their efficiency.

Yet another problem is that, since the mold cavity is heated, the water at the top, middle of the mold cavity freezes first and the freezing continues in outward directions. In this freezing process, the boundary between the ice and the water tends to push impurities to the outside of the cube. Thus, the impurities become highly visible on the outside of the cube and cause the cube to have an unappealing appearance. Also, the impurities tend to plate out or build up on the mold wall, thereby making ice cube removal more difficult.

A further problem is that vaporization of the water in the mold cavities causes frost to form on the walls of the freezer. More particularly, in a phenomenon termed "vapor flashing", vaporization occurs during the melting of the bond between the ice and the mold cavity. Moreover, vaporization adds to the latent load or the water removal load of the refrigerator.

Yet another problem is that the ice cube must be substantially completely frozen before it is capable of withstanding the stresses imparted by the melting and removal processes. This limits the throughput capacity of the ice maker.

Still another problem is that the fill tube coupled with the mold may jet water into the mold such that the water splatters from the mold cavity into an adjacent portion of the freezer unit. This obviously is not desirable since the splattered water then freezes and may interfere or reduce the efficiency of the ice maker or other components in the freezer unit.

What is needed in the art is an ice maker which quickly and effectively fills a mold cavity with water without splattering the water into adjacent portions.

SUMMARY OF THE INVENTION

The present invention provides a fill tube for an automatic ice maker which is structured and arranged relative to at least one mold cavity and an auger within the mold cavity to quickly and effectively fill the mold cavity without splattering water out of the mold.

The invention comprises, in one form thereof, an ice maker including a mold with at least one cavity for containing water therein for freezing into ice. Each cavity has a plurality of side walls. An ice removal device is positioned at least partly within the at least one mold cavity. A fill tube is positioned in association with the at least one mold cavity. The fill tube includes an outlet from which water is expelled at an impingement angle against at least one side wall of at least one mold cavity. The impingement angle is between about 10° and 60° relative to a horizontal reference.

The invention comprises, in another form thereof, a method of making ice in an automatic ice maker, including the steps of: providing a mold including at least one cavity, each cavity having a plurality of side walls; positioning an ice removal device at least partly in the at least one mold cavity; coupling a fill tube with the at least one mold cavity, the fill tube having an outlet; and expelling water from the outlet from an impingement angle against at least one side wall of the at least one mold cavity, the impingement angle being between 10° and 60° relative to a horizontal reference.

An advantage of the present invention is that the fill tube is structured and arranged relative to the mold to provide a fast fill cycle of water within the mold cavity.

Another advantage is that the mold cavity is filled without splattering water into an adjacent portion of the freezer unit.

Yet another advantage is that the fill tube may be quickly and easily assembled with the mold using barbed fasteners.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
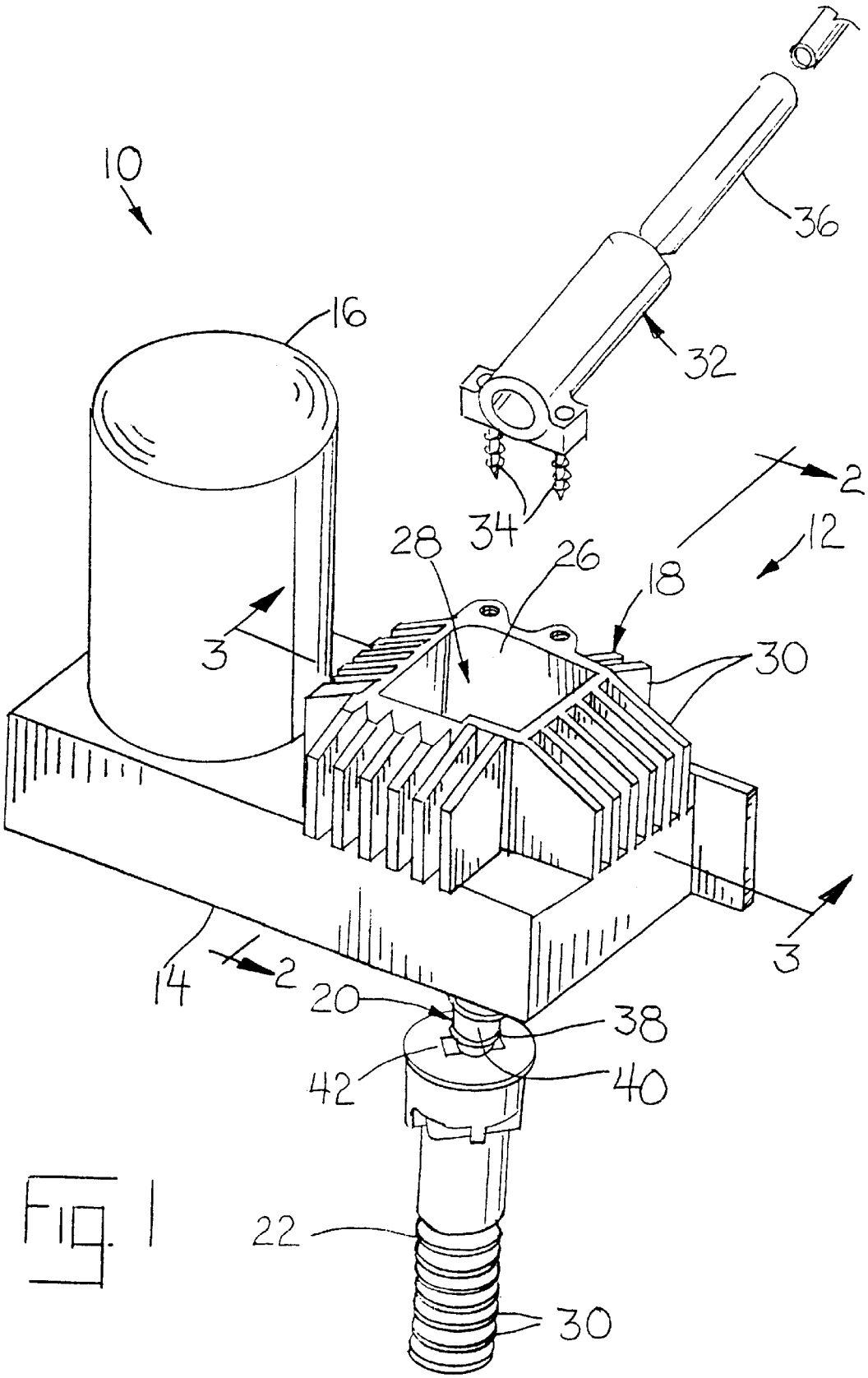
FIG. 1 is a perspective view of an embodiment of an ice maker in a partially disassembled state within a freezer unit.
Figure 2:
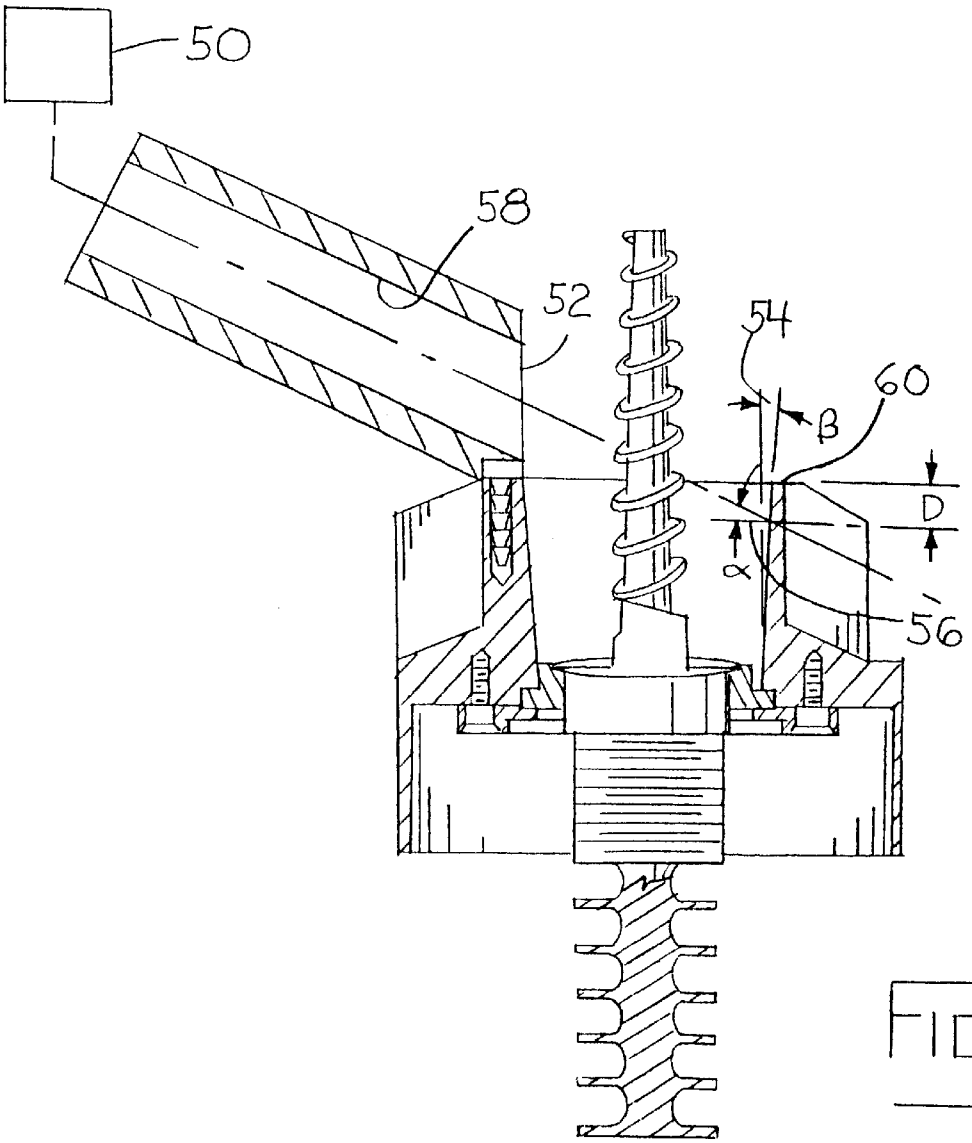
FIG. 2 is a partial, sectional view taken along line 2—2 in FIG. 1.

Referring now to the drawings, and more particularly to FIGS. 1 and 2, there is shown an embodiment of a freezer unit 10 within a freezer (not numbered). Freezer unit 10 includes an ice maker 12, which in turn generally includes a housing 14, drive motor 16, mold 18, auger 20 and heat transfer member 22.

Mold 18 includes a plurality of side walls 26 defining a mold cavity 28. Mold cavity 28 is configured for containing water therein for freezing into ice. Mold 18 includes a plurality of cooling fins 30 associated with each side wall 26. Cooling fins 30 provide an increased surface area allowing the water to be frozen into ice at a faster cooling rate within mold cavity 28. Mold 18 is carried by housing 14.

Fill tube 32 is coupled with and carried by mold 18 using fasteners 34. Each fastener 34 includes a plurality of barbs (not numbered) which allow push-in, interference engagement between fill tube 32 and mold 18. In the embodiment shown, fill tube 32 and fasteners 34 are each formed from a material with relatively poor heat transfer properties, such as plastic or the like. In this manner, fill tube 32 is thermally isolated to a great extent from mold 18, thereby inhibiting freezing of water within fill tube 32. Alternatively, it may be possible to place a thermally insulative washer, disk or the like between fill tube 32 and mold 18 to provide a thermal barrier therebetween. The mating surfaces between fill tube 32 and mold 18, as well as the use of fasteners 34, locate the discharge end of fill tube 32 relative to mold cavity 28 such that water is discharged at a particular impingement angle relative to one or more of side walls 26 of mold 18, as will be described in detail hereinafter.

More particularly, fill tube 32 is fluidly coupled with and receives pressurized water from a pressure source 50 such as a pressurized household water supply. Fill tube 32 includes an outlet 52 from which the water is expelled at an impingement angle a relative to an opposing side wall 26 within mold cavity 28 (FIG. 2). Each side wall 26 is disposed at a draft angle $\beta$ relative to a vertical reference 54 of between about 0° and 5°, preferably about 2°. Impingement angle $\alpha$ corresponding to the angle of the water expelled from outlet 52 relative to a horizontal reference 56 is between about 10° and 60°, preferably between about 25° and 35°, and more preferably about 30°.

Fill tube 32 has an inner flow passageway 58 which is structured and arranged, depending upon a pressure of water from pressure source 50, to provide water from outlet 52 at a flow velocity at between about 0.1 and 10feet per second, preferably between about 0.5 and 2 feet per second, and more preferably about 1 foot per second. Passageway 58 may for example be configured with a generally cylindrical shape, or a frustroconical shape providing an increased flow velocity at outlet 52.

Figure 3:
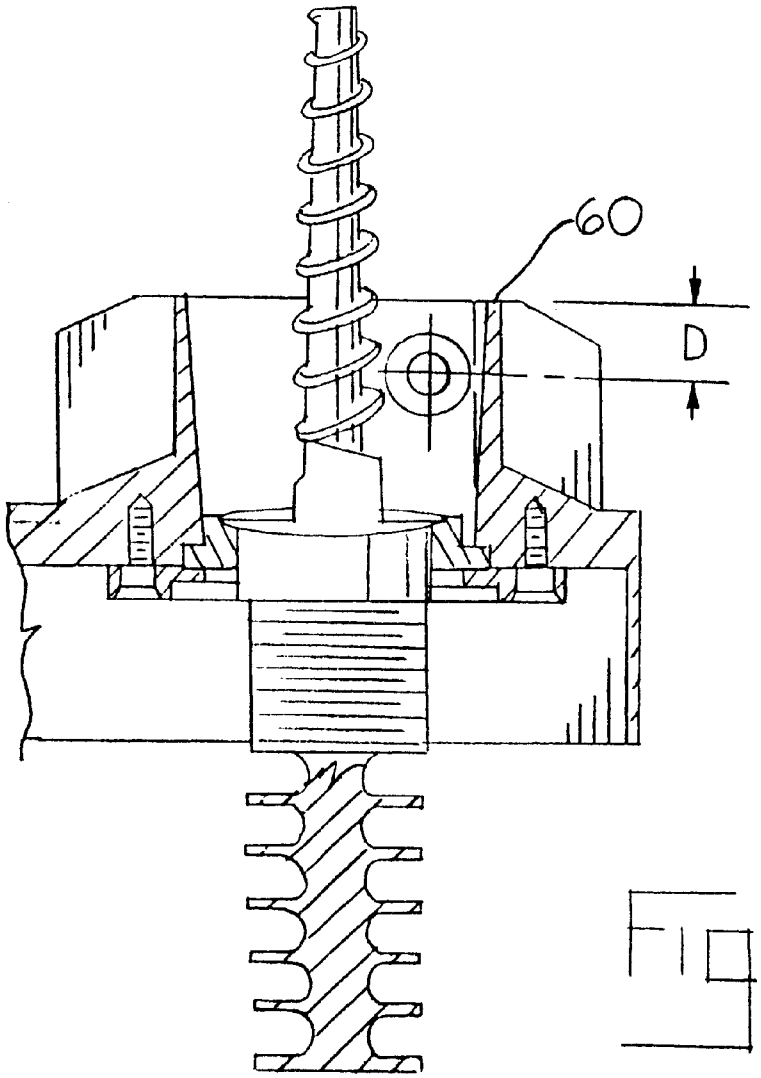
FIG. 3 is a partial, sectional view taken along line 3—3 in FIG. 1.

Fill tube 32 is also positioned relative to and coupled with mold 18 so that water does not directly impinge upon auger 20 during a fill cycle (FIG. 3). More particularly, fill tube 32 is positioned relative to mold 18 to expel water from outlet 52 at a flow diameter and directional vector causing the stream of water to flow between auger 20 and an adjacent side wall 26. The stream of water is preferably expelled from outlet 52 at a clearance distance relative to each of auger 20 and an adjacent side wall 26 of between about 1 and 3 millimeters, and preferably about 2 millimeters. The fluid stream thus defines a center impingement location against the opposite side wall 26 which is between about 1 and 20 millimeters from a top 60 of side wall 26, preferably between about 5 and 15 millimeters from top 60, and more preferably about 8 millimeters from top 60, as represented by distance D in FIGS. 2 and 3.

Using the various parameters as described above, including the flow velocity from outlet 52, impingement angle $\alpha$, distance D from top 60, and clearance distance between auger 20 and an adjacent side wall 26, it has been found that water may be quickly and effectively jetted into mold cavity 28 without splattering from mold 18 into surrounding areas within freezer unit 10. This in turn results in quicker fill and harvest cycles for ice maker 12, thereby increasing the throughput rate for harvested ice cubes.

Fill tube 32 includes a heater 36 which may be actuated using a controller (not shown) to periodically or continuously maintain fill tube 32 in an unfrozen or unclogged state. For details of the general operating principals of a heated fill tube which may be used with a freezer unit such as employed in the present invention, reference is hereby made to U.S. Pat. No. 6,157,777 entitled "Heater Assembly for a Fluid Conduit with an Internal Heater", which is assigned to the assignee of the present invention.

Auger 20 extends substantially vertically through mold cavity 28, with a distal end which extends past mold cavity 28 for the purpose of transporting an ice cube out of mold cavity 28. Auger 20, in the embodiment shown, is a tapered auger having a continuous flighting 38 extending around and carried by shaft 40. Each of flighting 38 and shaft 40 are tapered such that the distal end of auger 20 has a smaller diameter, thereby allowing a harvested ice cube to be more easily separated from auger 20. A shoulder 42 adjacent flighting 38 is positioned within mold cavity 28 to define a portion of the bottom wall of mold cavity 28. Auger 20 also fixedly carries a gear (not shown) allowing geared interconnection with motor 16 via a drive train (not shown). The drive train includes a plurality of gears which are appropriately sized and configured to provide a predetermined gear reduction ratio between motor 16 and auger 20. Motor 16 can of course be sized with an appropriate output power, output rotational speed and input electrical power requirements.

Heat transfer member 22 is metallurgically coupled with auger 20 and extends downwardly away from mold 18. Heat transfer member 22 functions to provide an increased surface area such that the cooling rate of the water within mold cavity 28 is enhanced. More particularly, heat transfer member 22 is monolithically formed with auger 20 to provide a maximum cooling rate to the water within mold cavity 28. If heat transfer member 22 was merely a separate piece which was mechanically coupled to auger 20, surface imperfections, even at the atomic level, would decrease the cooling efficiency of ice maker 12. By monolithically forming heat transfer member 22 with auger 20, heat transfer via conduction away from mold cavity 28 is improved, thereby improving the overall efficiency of ice maker 20.

Although heat transfer member 22 is shown as being monolithically formed with auger 20, it is also possible to metallurgically bond heat transfer member 22 to auger 20 by other techniques, such as welding, brazing, etc. providing continuous conduction without a surface-to-surface interface therebetween.

Because heat transfer member 22 is metallurgically coupled with and thus rigidly affixed to auger 20, heat transfer member 22 rotates with auger 20 during operation. Thus, heat transfer member 22 must be configured with an external shape allowing rotation within freezer unit 10 within described geometric constraints. In the embodiment shown, heat transfer member 22 includes a plurality of generally disc shaped fins 48 which are aligned generally coaxially with each other. More particularly, heat transfer member 22 includes seven generally disc shaped fins which are aligned generally coaxially with each other. Fins 48 function to provide an increased surface area to heat transfer member 22, thereby providing an increased heat transfer efficiency to ice maker 12.

Figure 4:
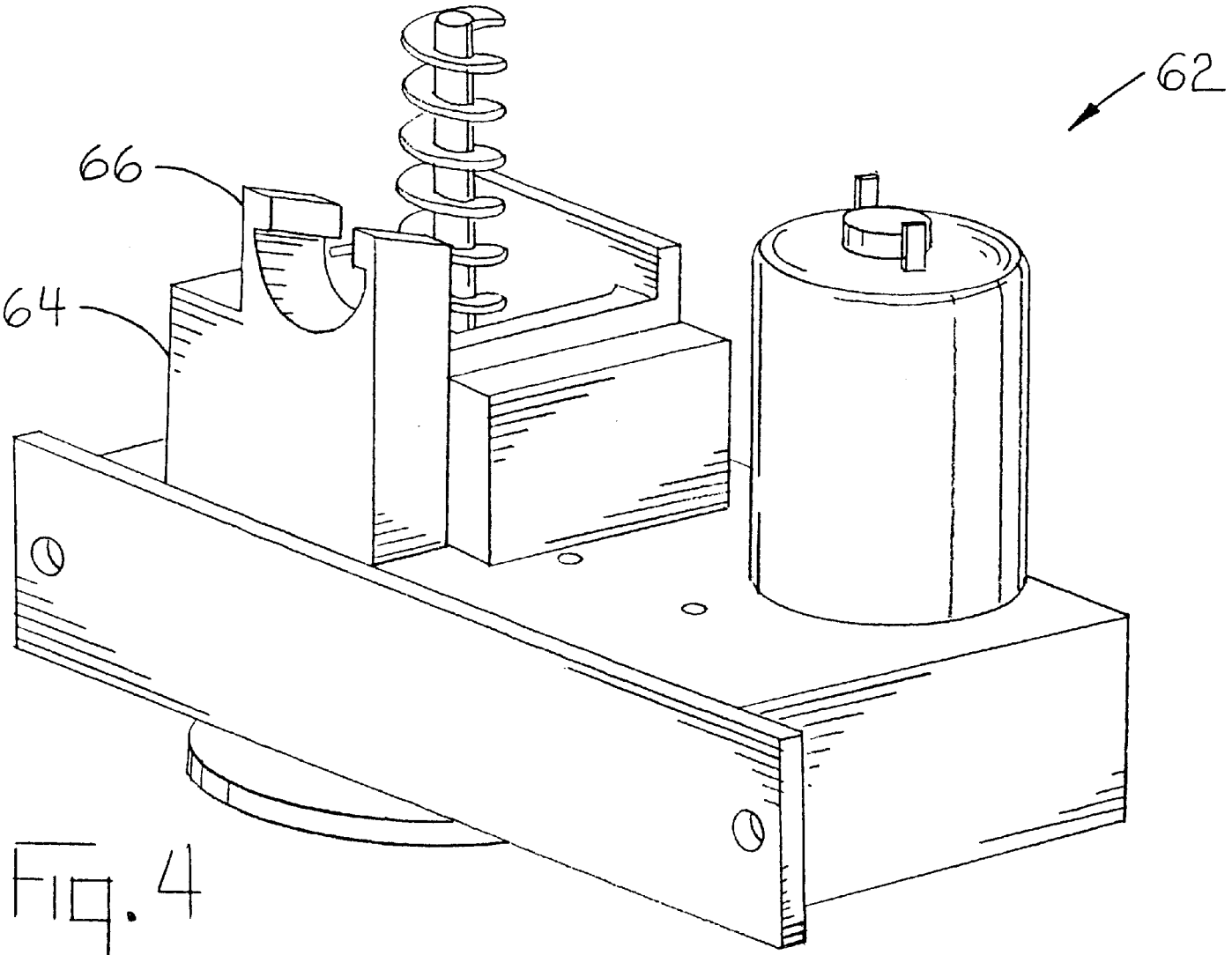
FIG. 4 is a partial, perspective view of another embodiment of an ice maker of the present invention.

FIG. 4 is perspective view of a portion of another embodiment of an ice maker 62 of the present invention. Ice maker 62 includes a mold 64 having a fill tube mount 66 which couples with a fill tube (not shown) such that the fill tube is oriented relative to mold 64 to provide the impingement angles, clearance distances, distance from the top wall, etc. as described above with reference to ice maker 12 shown in FIGS. 1–3. The corresponding fill tube has a semi-circular portion which fits within mount 66 and thereby effectively and accurately positions the fill tube relative to mold 64.

During use, water is ejected into mold cavity 28 from fill tube 32. Using the flow velocity of the water from outlet 52, impingement angle a, distance D from top 60 and clearance distance from auger 20 and an adjacent side wall 26, mold cavity 28 is quickly filled without splattering water into adjacent portions of freezer unit 10. Since mold cavity 28 has a non-circular cross section, rotational movement of auger 20 causes translational movement of the ice cube out of mold cavity 28. The heat transfer necessary to cool the water to form the ice cube is enhanced by heat transfer member 22 which is monolithically formed with and extends from auger 20 away from housing 14.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An ice maker, comprising:

a mold including at least one cavity for containing water therein for freezing into ice, each said cavity having a plurality of side walls;

an auger for ice removal at least partly within said at least one mold cavity; and a fill tube positioned in association with said at least one mold cavity, said fill tube including an outlet from which water is expelled at an impingement angle against at least one said side wall of at least one said cavity, said impingement angle being between about 10° and 60° relative to a horizontal reference, said fill tube being positioned to expel water from said outlet between said auger and one said side wall.

2. The ice maker of claim 1, said impingement angle being between about 25° and 35° relative to said horizontal reference.

3. The ice maker of claim 2, said impingement angle being about 30° relative to said horizontal reference.

4. The ice maker of claim 1, further including a pressure source for providing pressurized water to said fill tube, said fill tube being structured and arranged, dependent upon a pressure of water from said pressure source, to provide water from said outlet at a flow velocity of between about 0.1 and 10 feet per second.

5. The ice maker of claim 4, said fill tube being structured and arranged to provide water from said outlet at a flow velocity of between about 0.5 and 2 feet per second.

6. The ice maker of claim 5, said fill tube being structured and arranged to provide water from said outlet at a flow velocity of about 1 foot per second.

7. The ice maker of claim 1, each said side wall being disposed at a draft angle of between about 0° and 5° relative to a vertical reference.

8. The ice maker of claim 7, each said side wall being disposed at a draft angle of about 2° relative to said vertical reference.

9. The ice maker of claim 1, said fill tube being positioned to expel water from said outlet at a clearance distance of between about 1 and 3 millimeters from each of said auger and said one side wall.

10. The ice maker of claim 9, said fill tube being positioned to expel water from said outlet at a clearance distance of about 2 millimeters from each of said auger and said one side wall.

11. The ice maker of claim 1, each said side wall having a top, said fill tube being positioned to expel water from said outlet at an impingement location against said at least one side wall which is between about 1 and 20 millimeters from said top of said at least one side wall.

12. The ice maker of claim 11, said fill tube being positioned to expel water from said outlet at an impingement location against said at least one side wall which is between about 5 and 15 millimeters from said top of said at least one side wall.

13. The ice maker of claim 12, said fill tube being positioned to expel water from said outlet at an impingement location against said at least one side wall which is about 8 millimeters from said top of said at least one side wall.

14. The ice maker of claim 1, wherein said fill tube is configured to inhibit heat transfer with said mold.

15. An ice maker, comprising:

a mold including at least one cavity for containing water therein for freezing into ice, each said cavity having a plurality of side walls, said mold includes a plurality of openings, and further including a plurality of fasteners;

an ice removal device at least partly within said at least one mold cavity; and a fill tube positioned in association with said at least one mold cavity, said fill tube including an outlet from which water is expelled at an impingement angle against at least one said side wall of at least one said cavity, said impingement angle being between about 10° and 60° relative to a horizontal reference, said plurality of fasteners coupling said fill tube with said mold, each said fastener having at least one barb retained within a corresponding said opening.

16. A freezer, comprising:

an ice maker, including:

a mold including at least one cavity for containing water therein for freezing into ice, each said cavity having a plurality of side walls;

an auger for ice removal at least partly within said at least one mold cavity; and a fill tube positioned in association with said at least one mold cavity, said fill tube including an outlet from which water is expelled at an impingement angle against at least one said side wall of at least one said cavity, said impingement angle being between 10° and 60° relative to a horizontal reference, said fill tube being positioned to expel water from said outlet between said auger and one said side wall.

17. The freezer of claim 16, said impingement angle being between about 25° and 35° relative to said horizontal reference.

18. The freezer of claim 17, said impingement angle being about 30° relative to said horizontal reference.

19. The freezer of claim 16, said fill tube being positioned to expel water from said outlet at a clearance distance of between about 1 and 3 millimeters from each of said auger and said one side wall.

20. The freezer of claim 19, said fill tube being positioned to expel water from said outlet at a clearance distance of about 2 millimeters from each of said auger and said one side wall.

21. The freezer of claim 16, each said side wall having a top, said fill tube being positioned to expel water from said outlet at an impingement location against said at least one side wall which is between about 1 and 20 millimeters from said top of said at least one side wall.

22. The freezer of claim 21, said fill tube being positioned to expel water from said outlet at an impingement location against said at least one side wall which is between about 5 and 15 millimeters from said top of said at least one side wall.

23. The freezer of claim 22, said fill tube being positioned to expel water from said outlet at an impingement location against said at least one side wall which is about 8 millimeters from said top of said at least one side wall.

* * * * *